US008968016B1

(12) United States Patent
Wu

(10) Patent No.: US 8,968,016 B1
(45) Date of Patent: Mar. 3, 2015

(54) BUS STRUCTURE, TERMINAL BLOCK, AND TERMINAL BLOCK ASSEMBLY FORMED THEREFROM

(71) Applicant: Dinkle Enterprise Co., Ltd., New Taipei (TW)

(72) Inventor: Shang Tsai Wu, New Taipei (TW)

(73) Assignee: Dinkle Enterprise Co., Ltd., New Taipei (TW)

( * ) Notice: Subject to any disclaimer, the term of this patent is extended or adjusted under 35 U.S.C. 154(b) by 50 days.

(21) Appl. No.: 13/972,269

(22) Filed: Aug. 21, 2013

(51) Int. Cl.
*H01R 4/60* (2006.01)
*H01R 9/26* (2006.01)

(52) U.S. Cl.
CPC ..... *H01R 9/26* (2013.01)
USPC ..... 439/214

(58) Field of Classification Search
USPC ..... 439/214, 211, 215, 216, 209, 716
See application file for complete search history.

(56) References Cited

U.S. PATENT DOCUMENTS

| | | | | |
|---|---|---|---|---|
| 5,486,979 | A * | 1/1996 | Bowen et al. | 361/640 |
| 5,670,743 | A * | 9/1997 | Welch et al. | 174/377 |
| 8,668,518 | B2 * | 3/2014 | Wu | 439/532 |
| 2013/0237067 | A1 * | 9/2013 | Wu | 439/76.1 |

* cited by examiner

*Primary Examiner* — Ross Gushi
(74) *Attorney, Agent, or Firm* — Birch, Stewart, Kolasch & Birch, LLP

(57) ABSTRACT

A bus structure includes a positioning rail, a bus body and bus bars. The bus body has a projecting portion and a depressed portion. The projecting portion has a ramp. A terminal block includes a housing and a connector, one of which includes a projecting portion and a depressed portion. The depressed portion has a ramp. Also disclosed is a terminal block assembly formed by combining the bus structure and the terminal block. The projecting portion of one of the housing and the connector engages with the depressed portion of the bus body and the projecting portion of the bus body is inlaid into the depressed portion of one of the housing and the connector, so that the ramps of the bus body and of the terminal block retain each other, thereby effectively preventing reverse combination between the bus structure and the terminal block, and preventing breakage of components thereof.

6 Claims, 11 Drawing Sheets

BUS STRUCTURE, TERMINAL BLOCK, AND TERMINAL BLOCK ASSEMBLY FORMED THEREFROM

BACKGROUND OF THE INVENTION

1. Technical Field

The present invention relates to a bus structure for a bus structure, a terminal block, and a terminal block assembly formed therefrom. More particularly, it relates to a bus structure, a terminal block, and a terminal block assembly formed therefrom that help to prevent device failure due to wrong, reverse combination between the bus structure and the terminal block.

2. Description of Related Art

A terminal block is an electronic component extensively used in various machines, whose function is to connect two or more sets of power cords, control wires or data transmission lines. Such a terminal block is typically configured to work with a bus structure.

Particularly, the bus structure comprises a bus body and a positioning rail combined together. The bus body is provided with plural bus bars, and the terminal block is removably mounted on a positioning rail, so that a connector built in the terminal block can be engaged with the bus bars for electrical connection.

In order to prevent wrong installation, a traditional terminal block is designed with a fool-proof structure. As shown in FIG. 10, the bus body 91 has a projecting portion 911 and a depressed portion 912, while the connector 920 of the terminal block 92 also has a projecting portion 921 and a depressed portion 922. When the bus body 91 and the terminal block 92 are correctly combined, the projecting portion 911 of the bus body 91 can get engaged with the depressed portion 922 of the connector 920, and the projecting portion 921 of the connector 920 can be inlaid into the depressed portion 912 of the bus body 91. On the other hand, in case of reverse installation, as shown in FIG. 11, the projecting portion 911 of the bus body 91 with interfere with the projecting portion 921 of the connector 920, disallowing the bus body 91 and the terminal block 92 to be combined.

While the traditional fool-proof structure is somehow workable to prevent wrong installation, in the event that a larger pushing force is applied to push the terminal block 92 toward the bus body 91, relative sliding can happen between the bus body 91 and the terminal block 92. In other words, though the projecting portion 911 of the bus body 91 and projecting portion 921 of the connector 920 can retain each other to some extent, when the applied force is relatively large, the both can still slide with respect to each other, making the connecting components of the both impact and in turn break.

SUMMARY OF THE INVENTION

According to the present invention, a bus structure comprises a positioning rail, a bus body and a plurality of bus bars.

The positioning rail has a U-shaped sectional shape and includes a bottom and two raised edges, wherein the two raised edges are extended upward from two opposite sides of the bottom and then outward. The bus body is settled on the bottom and has a plurality of holding grooves, a projecting portion and a depressed portion. The holding grooves are located between the projecting portion and the depressed portion. The projecting portion is adjacent to one side of the bus body close to one of the two raised edges, and the depressed portion is depressed with respect to the projecting portion and being adjacent to an opposite side of the bus body close to the other of the two raised edges. The projecting portion includes an outer ramp that expands outward as extending downward. Each of the plurality of bus bars is received in one of the plurality of holding grooves.

According to the present invention, a terminal block comprises a housing and a connector.

The housing comprises a connecting socket that is to be received in the connecting socket. The connector has a plurality of terminal sockets that are spaced apart and exposed outside the housing. One of the housing and the connector comprises a projecting portion and a depressed portion. The depressed portion is depressed with respect to the projecting portion and comprises an inner ramp that draws back as extending upward. The terminal sockets are arranged between the projecting portion and the depressed portion.

The foregoing terminal block may further comprise a sliding clip and a resilient member. The sliding clip is slidably mounted on the housing so that it can slide toward or away from the terminal sockets. The sliding clip at its end close to the terminal sockets has an upper recess, a lower recess and an inclined plane. The inclined plane is inclined from the upper recess toward the lower recess in a direction leaving the terminal sockets. The resilient member props between the housing and the sliding clip for providing a spring preload for facilitating the sliding clip in sliding.

According to the present invention, a terminal block assembly comprises the bus structure and the terminal block without the sliding clip and the resilient member. The terminal block is installed on the bus structure so that each said terminal socket receives one said bus bar. The projecting portion of one of the housing and the connector is engaged with the depressed portion of the bus body, and the projecting portion of the bus body is engaged with the depressed portion of one of the housing and the connector. The outer ramp on the projecting portion of the bus body and the inner ramp on the depressed portion of one of the housing and the connector retaining each other.

In another embodiment of the present invention, a terminal block assembly comprises the bus structure and the terminal block having the sliding clip and the resilient member as described above. The terminal block is installed on the bus structure so that each said terminal socket receives one said bus bar. The projecting portion of one of the housing and the connector is engaged with the depressed portion of the bus body, and the projecting portion of the bus body is engaged with the depressed portion of one of the housing and the connector. The outer ramp on the projecting portion of the bus body and the inner ramp on the depressed portion of one of the housing and the connector retaining each other. The upper recess of the sliding clip is engaged with one of the two raised edges of the positioning rail.

With the configuration described above, the present invention can effectively prevent wrong, reverse installation and consequent breakage of components.

DETAILED DESCRIPTION OF THE INVENTION

Figure 1:
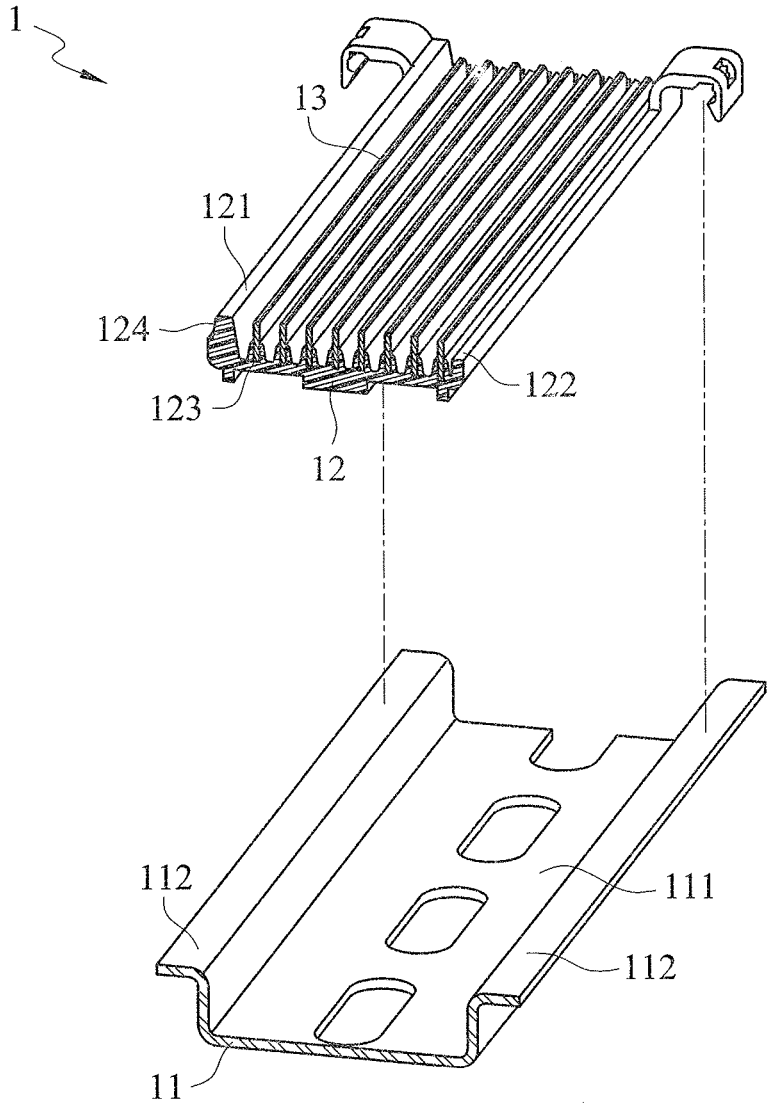
FIG. 1 is a perspective view of a bus structure according to one preferred embodiment of the present invention.

Please refer to FIG. 1 for a perspective view of a bus structure according to one preferred embodiment of the present invention.

As shown, the bus structure 1 comprises a positioning rail 11, a bus body 12 and a plurality of bus bars 13.

The depicted positioning rail 11 has a U-shaped sectional shape and includes a bottom 111 and two raised edges 112. The two raised edges 112 are extended upward from two opposite sides of the bottom 111 and then outward. The bus body 12 is settled on the bottom 111 of the positioning rail 11. The bus body 12 has a plurality of holding grooves 123, a projecting portion 121 and a depressed portion 122. The holding grooves 123 are located between the projecting portion 121 and the depressed portion 122. The projecting portion 121 is adjacent to one of the opposite sides of the bus body 12 corresponding to one of the raised edges 112 while the depressed portion 122 is relatively depressed with respect to the projecting portion 121 and adjacent to the other of the opposite sides of the bus body 12 corresponding to the other raised edge 112. The projecting portion 121 comprises an outer ramp 124 that expands outward as extending downward. The bus bars 13 are received in the holding grooves 123 of the bus body 12, respectively.

Figure 2:
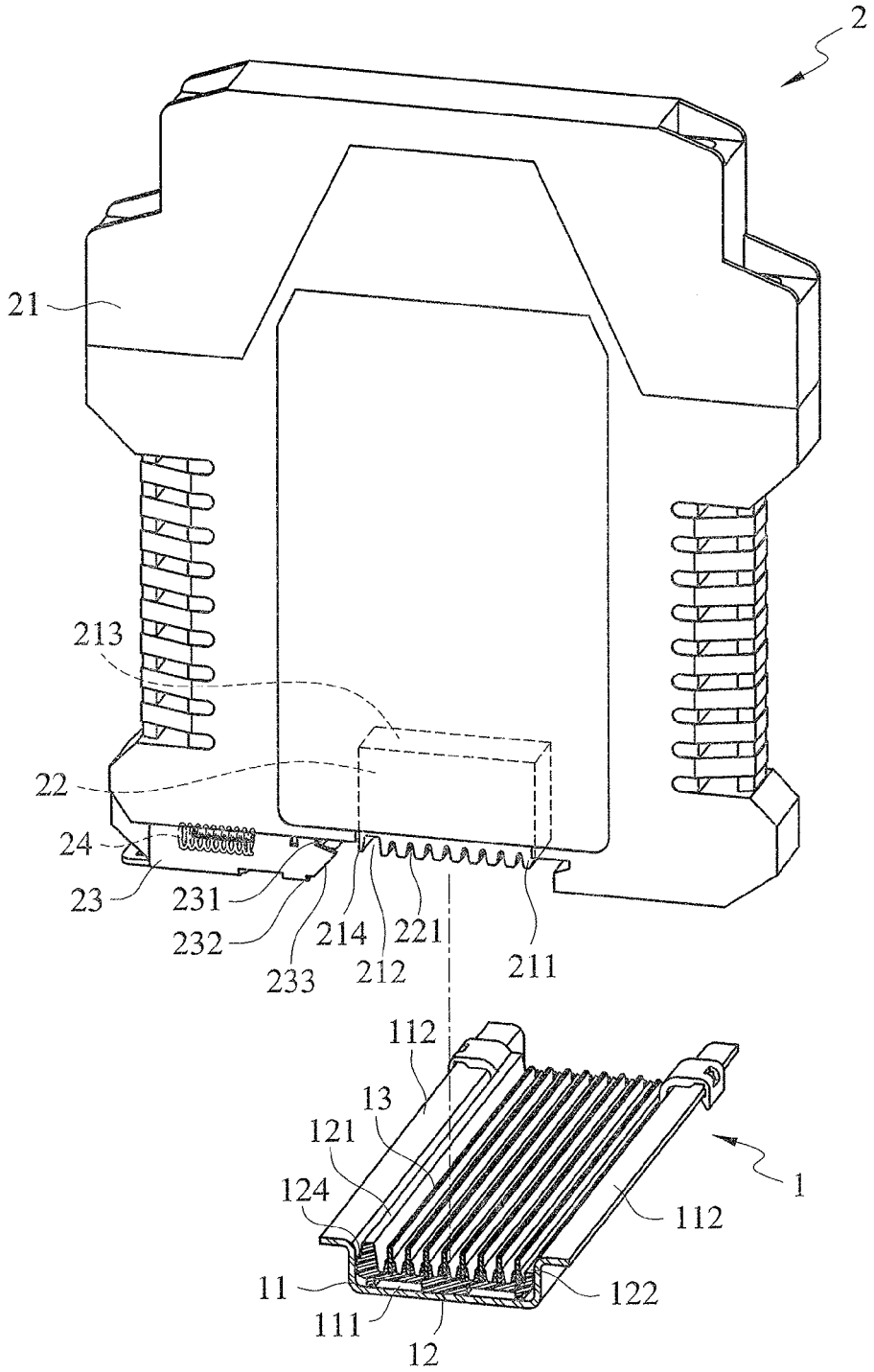
FIG. 2 is a perspective view of a terminal block according to one preferred embodiment of the present invention.

Please refer to FIG. 2 for a perspective view of a terminal block according to one preferred embodiment of the present invention.

As shown, the terminal block 2 is configured to work with the bus structure 1 (referring to FIG. 1), and comprises a housing 21 and a connector 22.

The depicted housing 21 includes a connecting socket 213 for receiving the connector 22. The connector 22 comprises a plurality of terminal sockets 221 that are spaced apart and exposed outside the housing 21.

Additionally, the housing 21 or the connector 22 has a projecting portion 211 and a depressed portion 212. The depressed portion 212 is depressed with respect to the projecting portion 211, and comprises an inner ramp 214 that draws back as extending upward.

As shown, in the present embodiment, the projecting portion 211 and the depressed portion 212 are both formed on the connector 22. Alternatively, the projecting portion 211 and the depressed portion 212 may be both formed on the housing 21.

Furthermore, in the present embodiment, the terminal sockets 221 are arranged between the projecting portion 211 and the depressed portion 212.

Figure 3:
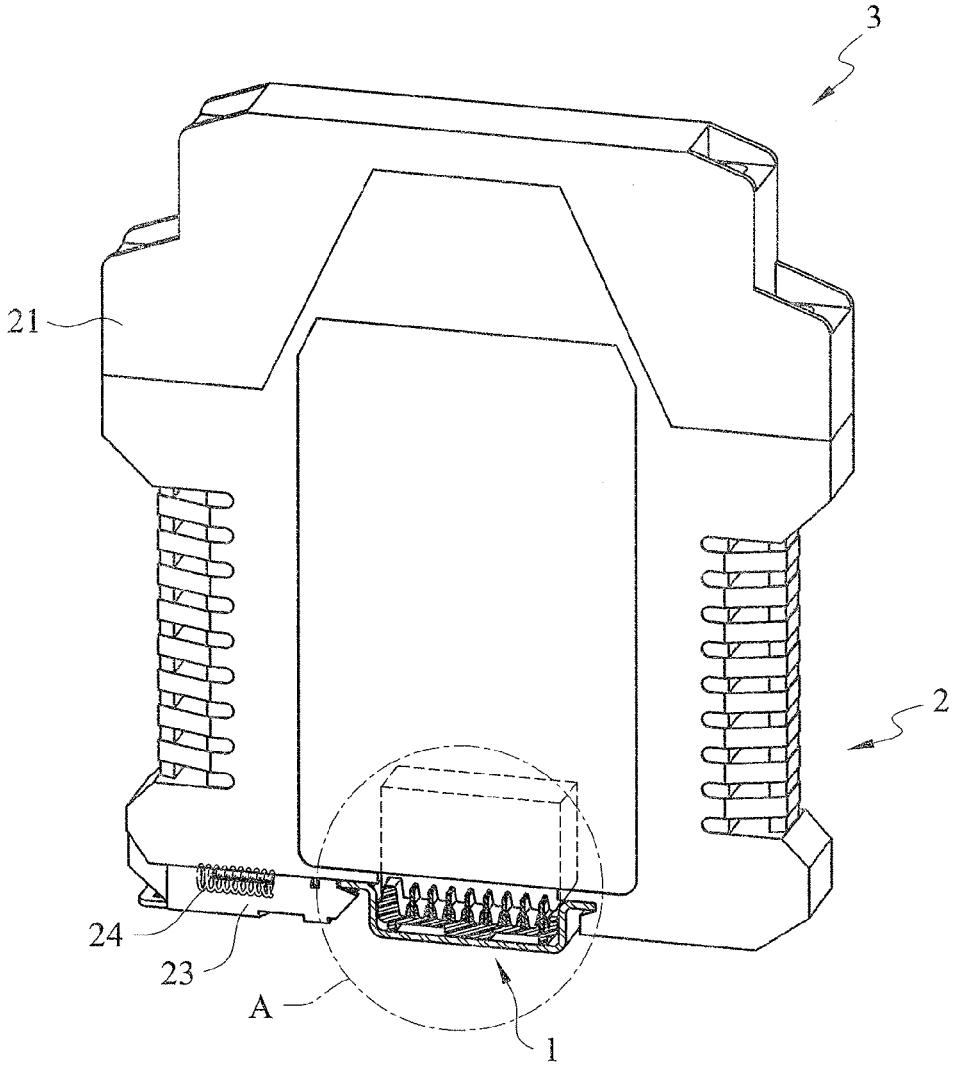
FIG. 3 is a perspective view of a terminal block assembly according to one preferred embodiment of the present invention.
Figure 4:
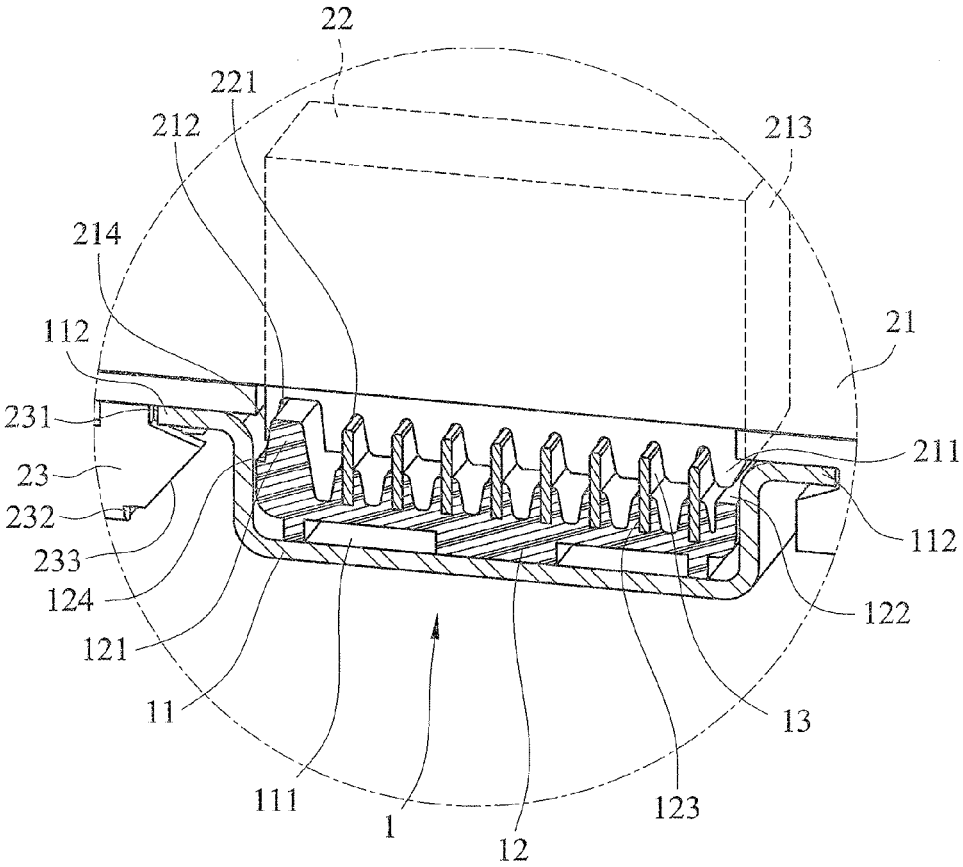
FIG. 4 is an enlarged view of Part A of FIG. 3.

Now please refer to FIG. 3 and FIG. 4. FIG. 3 is a perspective view of a terminal block assembly according to one preferred embodiment of the present invention. FIG. 4 is an enlarged view of Part A of FIG. 3. FIG. 1 and FIG. 2 will be referred to in the following description as well.

As depicted, the terminal block assembly 3 consists of the bus structure 1 (referring to FIG. 1) and the terminal block 2 (referring to FIG. 2) that are described above.

Therein, the terminal block 2 is inserted into the bus structure 1, so that the terminal sockets 221 are engaged with the bus bars 13, respectively. The projecting portion 211 of the connector 22 is engaged with the depressed portion 122 of the bus body 12, and the projecting portion 121 of the bus body 12 is engaged with the depressed portion 212 of the connector 22, while the outer ramp 124 on the projecting portion 121 of the bus body 12 fittingly contacts the inner ramp 214 on the depressed portion 212 of the connector 22.

As shown in FIG. 3 and FIG. 4, in normal use, the projecting portion 211 of the connector 22 is inlaid into the depressed portion 122 of the bus body 12, and the projecting portion 121 of the bus body 12 is inlaid into the depressed portion 212 of the connector 22, while the outer ramp 124 on the projecting portion 121 of the bus body 12 fittingly contacts the inner ramp 214 on the depressed portion 212 of the connector 22. In other words, the terminal block 2 is well inserted into the bus structure 1, thereby ensuring good electrical connection.

Figure 5:
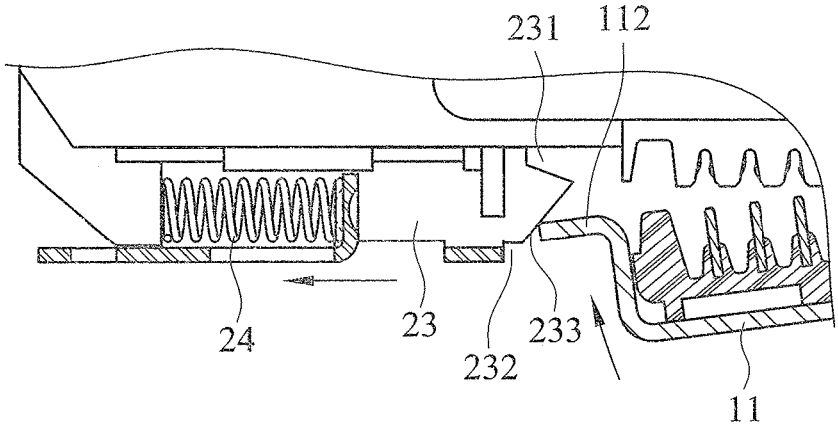
FIG. 5 is a cross-sectional drawing showing the operation of a sliding clip according to one preferred embodiment of the present invention.

Please refer to FIG. 5 for a cross-sectional drawing showing the operation of a sliding clip according to one preferred embodiment of the present invention. Reference will be also made to FIG. 3 and FIG. 4.

As shown, the terminal block 2 in the present embodiment further has the sliding clip 23 and a resilient member 24. Therein, the sliding clip 23 is slidably mounted on the housing 21 so that it can slide toward or away from the terminal sockets 221. The sliding clip 23 at its end close to the terminal sockets 221 has an upper recess 231, a lower recess 232 and an inclined plane 233. The inclined plane 233 is inclined from the upper recess 231 toward the lower recess 232 in a direction leaving the terminal sockets 221. The resilient member 24 props between the housing 21 and the sliding clip 23 for providing a spring preload for facilitating the sliding clip 23 in sliding.

In the present embodiment, the resilient member 24 is a spring.

In the foregoing normal use, or, when the terminal block 2 is inserted into the bus structure 1 in a correct direction, the inclined plane 233 of the sliding clip 23 abuts against one of the raised edges 112 of the positioning rail 11 (as depicted, the left raised edge 112). Afterward, when the terminal block 2 is continuously pushed downward into the bus structure 1, the sliding clip 23 first slides leftward as the inclined plane 233 abuts against the raised edge 112 (as indicated by the arrow in FIG. 5). When the terminal block 2 is finally hilly engaged with the bus structure 1, the sliding clip 23 slides rightward due to the spring preload of the resilient member 24. At this time, the upper recess 231 of the sliding clip 23 is engaged with one of the two raised edges 112 of the positioning rail 11. As shown in FIG. 4, the upper recess 231 of the sliding clip 23 is engaged with the left raised edge 112 of the positioning rail 11.

Figure 6:
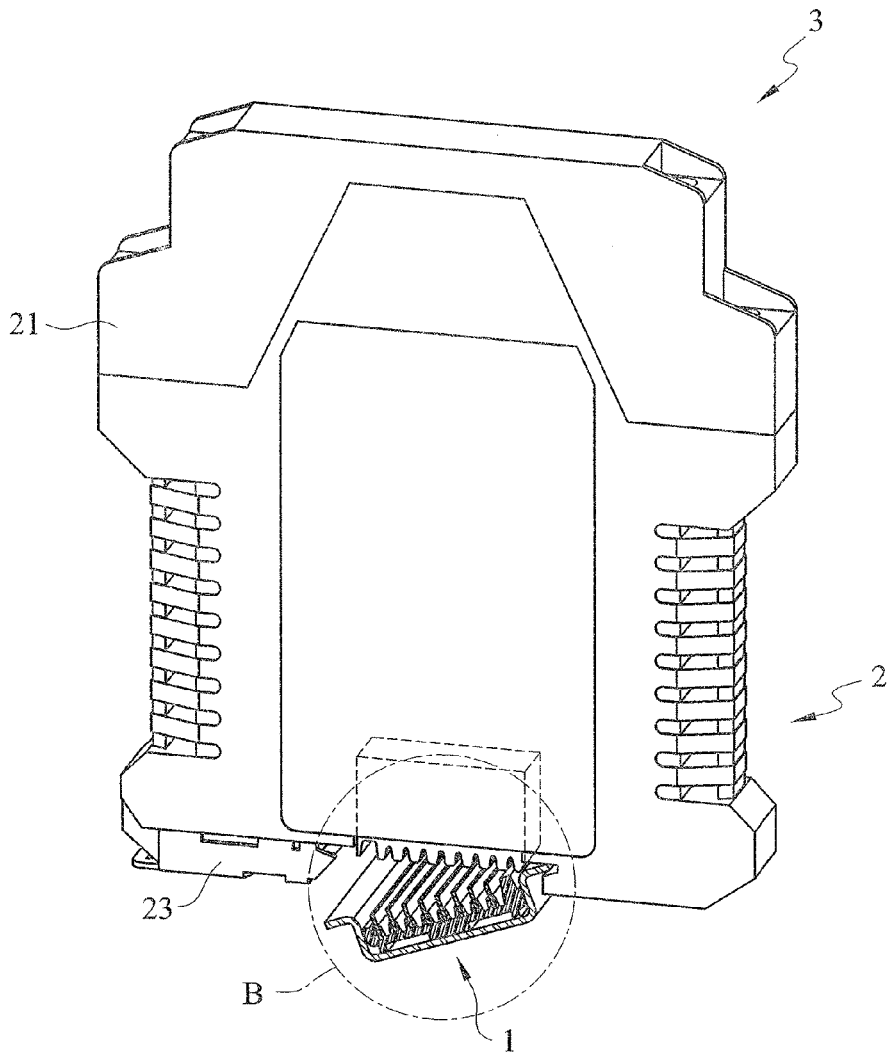
FIG. 6 is another perspective view of the terminal block assembly according to the preferred embodiment of the present invention.
Figure 7:
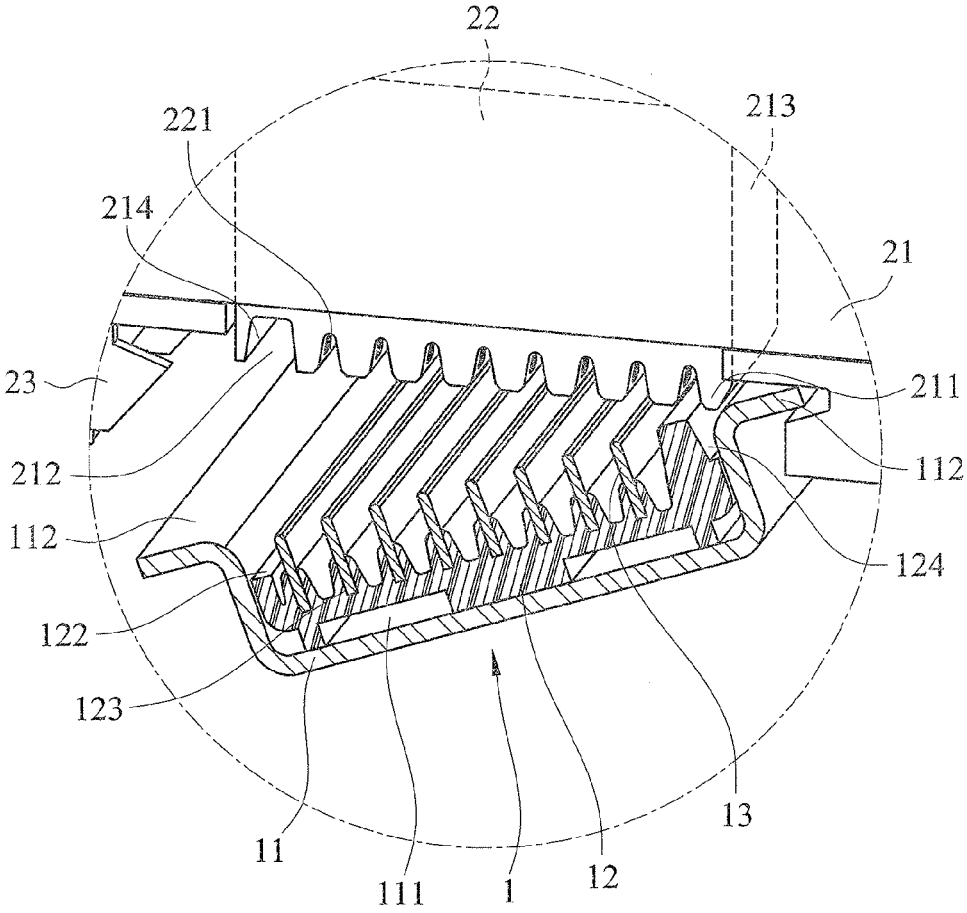
FIG. 7 is an enlarged view of Part B of FIG. 6.
Figure 8:
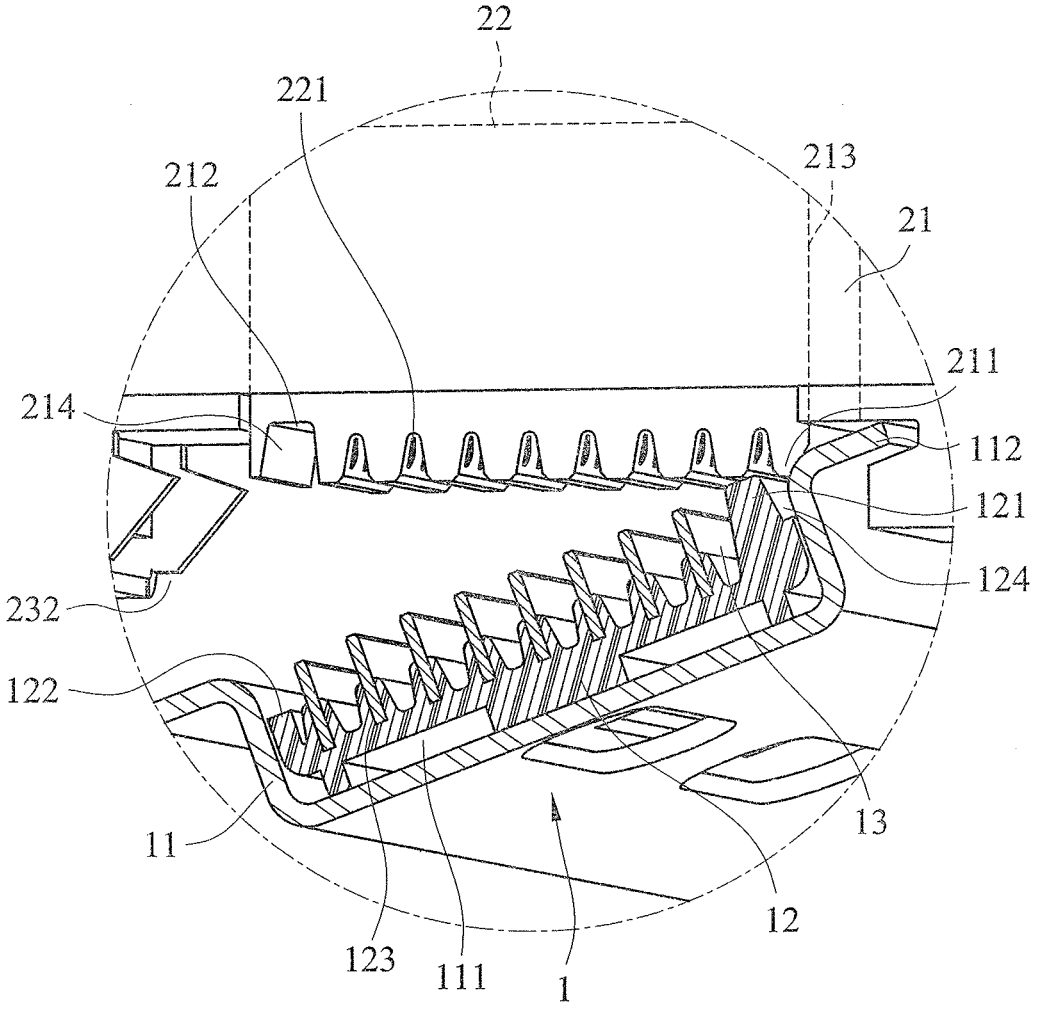
FIG. 8 is another enlarged view of Part B of FIG. 6.
Figure 9:
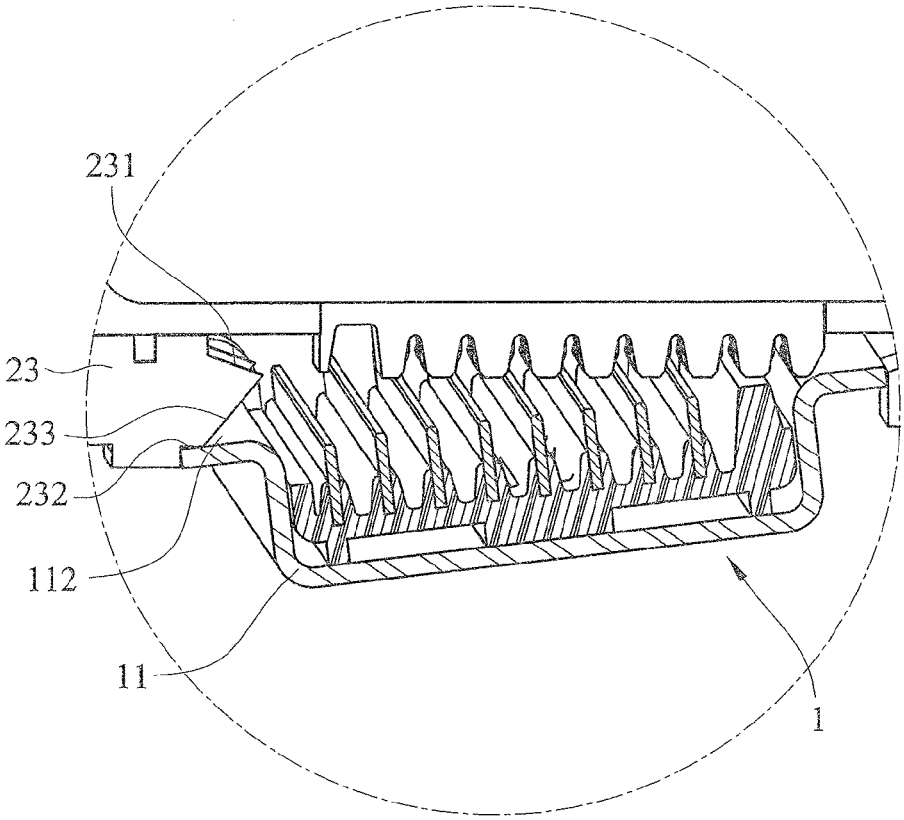
FIG. 9 is a schematic drawing showing that the sliding clip abuts against raised edge when the terminal block of FIG. 6 is reversely inserted into the bus structure.
Figure 10:
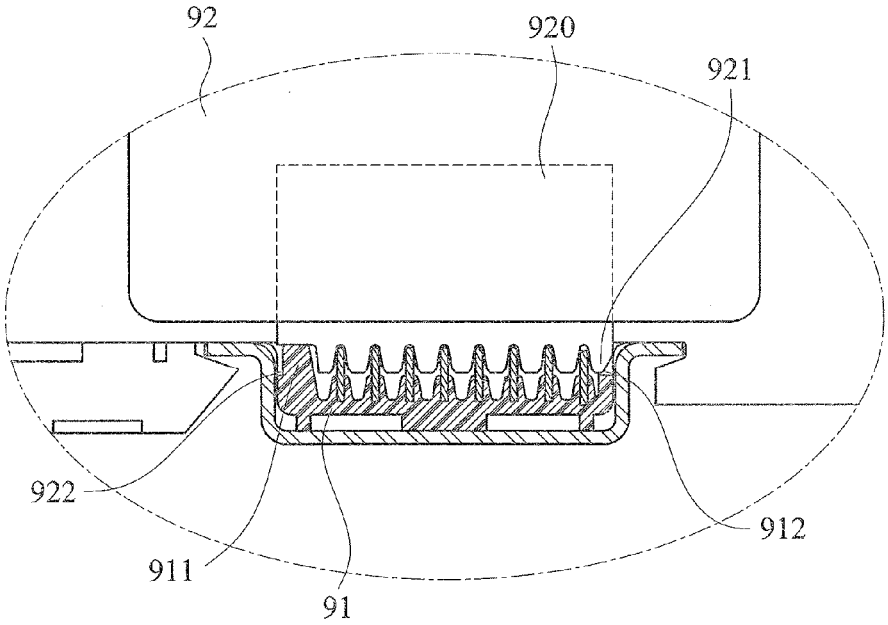
FIG.10 (PRIOR ART)
FIG. 10 is a schematic drawing showing a conventional bus structure assembled to a terminal block.
Figure 11:
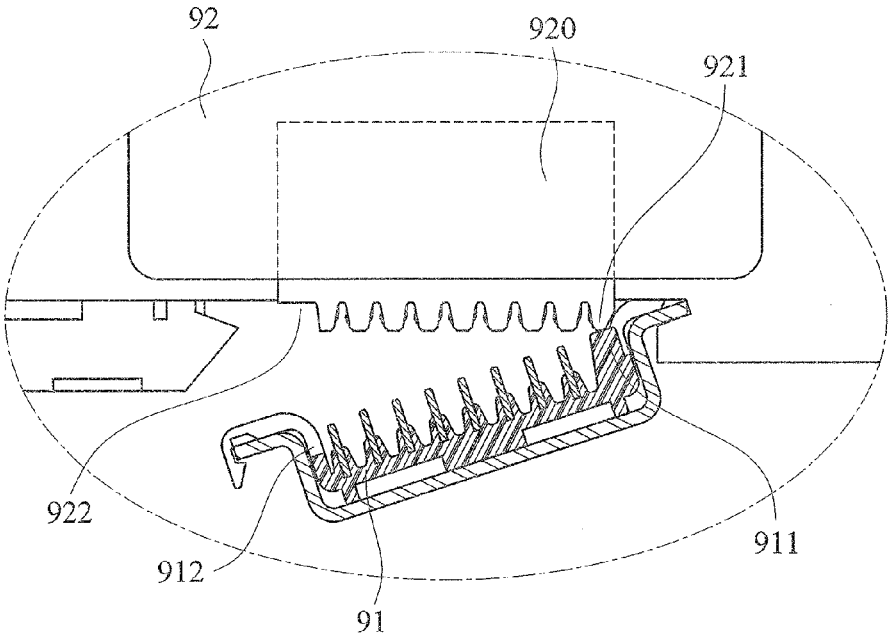
FIG.11 (PRIOR ART)
FIG. 11 is another schematic drawing showing the conventional bus structure assembled to a terminal block.

Please refer to FIG. 6 through FIG. 9. FIG. 6 is another perspective view of the terminal block assembly according to the preferred embodiment of the present invention. FIG. 7 is an enlarged view of Part B of FIG. 6. FIG. 8 is another enlarged view of Part B of FIG. 6. FIG. 9 is a schematic drawing showing when the terminal block of FIG. 6 is reversely inserted into the bus structure, the sliding clip abutting against raised edge. The following description will be also referred to FIG. 1 and FIG. 2.

In the event that the terminal block 2 is reversely inserted into the bus structure 1, the projecting portion 211 of the connector 22 will retain the projecting portion 121 of the bus body 12. Due to the outer ramp 124 on the projecting portion 121 of the bus body 12, the projecting portion 211 of the connector 22 slides into and gets engaged with the outer ramp 124, as shown in FIG. 8. In other words, the terminal sockets 221 are prevented from entering the bus bars 13. Even if a large pushing force is applied, the projecting portion 121 of the bus body 12 and the projecting, portion 211 of the connector 22 will not slide with respect to each other and render the electrically connecting components of the bus body 12 and of the connector 22 to impact mutually and in turn break.

Also, the outer ramp 124 on the projecting portion 121 of the bus body 12 helps the projecting portion 211 of the connector 22 to slide into and gets engaged with the outer ramp 124. The sliding causes a horizontal displacement that in turn makes the lower recess 232 of the sliding clip 23 engaged with the raised edge 112 of the positioning rail 11, as shown in FIG. 9. Stating differently, when the terminal block 2 is reversely positioned and continuously pushed into the bus structure 1, since the lower recess 232 is engaged with the raised edge 112, even if a large force is applied, the terminal block 2 cannot be inserted into the bus structure 1. This effectively prevents the wrong, reverse combination of the terminal block 2 and the bus structure 1.

Therefore, the projecting portion 211 of the connector 22, the projecting portion 121 of the bus body 12 and the sliding clip 23 as described above jointly form a fool-proof structure that prevents the terminal block 2 from being inserted into the bus structure 1 when the two are combined reversely, thereby preventing the terminal sockets 221 from receiving the bus bars 13 for electrical connection.

Moreover, with the outer ramp 124, the projecting portion 121 of the bus body 12 and the projecting portion 211 of the connector 22 are held from relative sliding that causes the electrical components of the bus body 12 and of the connector 22 to impact mutually and break.

In other words, with the configuration described above, the prevent invention can effectively prevent wrong installation and consequent breakage of components.

What is claimed is:

1. A bus structure for a terminal block, the bus structure comprising:

a positioning rail, having a U-shaped sectional shape and including a bottom and two raised edges, wherein the two raised edges are extended upward from two opposite sides of the bottom and then outward;

a bus body, settled on the bottom and having a plurality of holding grooves, a projecting portion and a depressed portion, the holding grooves being located between the projecting portion and the depressed portion, the projecting portion being adjacent to one side of the bus body close to one of the two raised edges, the depressed portion being depressed with respect to the projecting portion and being adjacent to an opposite side of the bus body close to the other of the two raised edges, and the projecting portion including an outer ramp that expands outward as extending downward; and a plurality of bus bars, each received in one said holding groove.

2. A terminal block, for working with the bus structure of claim 1, the terminal block comprising:

a housing, including a connecting socket; and a connector, being received in the connecting socket and including a plurality of terminal sockets that are spaced apart and exposed outside housing, wherein, one of the housing and the connector has a projecting portion and a depressed portion, in which the depressed portion is depressed with respect to the projecting portion and includes an inner ramp that draws back as extending upward.

3. The terminal block of claim 2, wherein the terminal sockets are arranged between the projecting portion and the depressed portion.

4. The terminal block of claim 2, further comprising a sliding clip and a resilient member, wherein the sliding clip is slidably mounted on the housing so as to slide toward or away from the terminal sockets, and at an end thereof close to the terminal sockets has an upper recess, a lower recess and an inclined plane, in which the inclined plane is inclined from the upper recess toward the lower recess in a direction leaving the terminal sockets, and the resilient member props between the housing and the sliding clip for providing a spring preload for facilitating the sliding clip in sliding.

5. A terminal block assembly according to claim 4, wherein the terminal block is installed on the bus structure so that each said terminal socket receives one said bus bar, the projecting portion of one of the housing and the connector being engaged with the depressed portion of the bus body, the projecting portion of the bus body being engaged with the depressed portion of one of the housing and the connector, the outer ramp on the projecting portion of the bus body and the inner ramp on the depressed portion of one of the housing and the connector retaining each other, and the upper recess of the sliding clip being engaged with one of the two raised edges of the positioning rail.

6. A terminal block assembly according to claim 2, wherein the terminal block is installed on the bus structure so that each said terminal socket receives one said bus bar, the projecting portion of one of the housing and the connector being engaged with the depressed portion of the bus body, the projecting portion of the bus body being engaged with the depressed portion of one of the housing and the connector, and the outer ramp on the projecting portion of the bus body and the inner ramp on the depressed portion of one of the housing and the connector retaining each other.

* * * * *